US007034757B2

(12) United States Patent
Martek et al.

(10) Patent No.: US 7,034,757 B2
(45) Date of Patent: Apr. 25, 2006

(54) WHIP ANTENNA HIGH VOLTAGE PROTECTION DEVICE WITH AN INTEGRATED ELECTRIC CHARGE BLEED-OFF SYSTEM

(75) Inventors: Gary A Martek, Blythewood, SC (US); John R Lewis, Jr., Little Mountain, SC (US)

(73) Assignee: Shakespeare Company, LLC, Columbia, SC (US)

( * ) Notice: Subject to any disclaimer, the term of this patent is extended or adjusted under 35 U.S.C. 154(b) by 24 days.

(21) Appl. No.: 10/819,051

(22) Filed: Apr. 6, 2004

(65) Prior Publication Data

US 2005/0225491 A1 Oct. 13, 2005

(51) Int. Cl.
*H01Q 1/52* (2006.01)

(52) U.S. Cl. ..... 343/722; 343/715

(58) Field of Classification Search ..... 343/720, 343/722, 749, 900; 361/117–119
See application file for complete search history.

(56) References Cited

U.S. PATENT DOCUMENTS

| | | | | |
|---|---|---|---|---|
| 4,498,086 A * | 2/1985 | Sandler | ..... | 343/807 |
| 4,513,338 A | 4/1985 | Goodall et al. | ..... | 361/1 |
| 6,366,251 B1 | 4/2002 | Pokryvailo et al. | ..... | 343/722 |

* cited by examiner

*Primary Examiner*—Michael C. Wimer
(74) *Attorney, Agent, or Firm*—Renner Kenner Greive Bobak Taylor & Weber

(57) ABSTRACT

An antenna protection device includes a pair of opposed contacts, an inner electrode connected to one of the contacts. The outer electrode is separated from the inner electrode by a dielectric layer and connected to the other of the contacts. A bleed-off resistor is connected between the opposed contacts to dissipate any accumulated. Corona rings may be employed around the foregoing components to improve operation of the device.

15 Claims, 5 Drawing Sheets

WHIP ANTENNA HIGH VOLTAGE PROTECTION DEVICE WITH AN INTEGRATED ELECTRIC CHARGE BLEED-OFF SYSTEM

TECHNICAL FIELD

This invention relates to antenna systems. More particularly, the present invention relates to an antenna component that provides high voltage protection and dissipation of excessive electric charge.

BACKGROUND ART

It is known in the prior art to integrate a protective capacitor to act as a high-pass filter within an antenna. Such a protective element allows the radio frequency function of a whip antenna while providing substantial series impedance in the event of unintended contact with over-head high-voltage electric lines that a vehicle employing a large whip antenna may encounter. For example, the patents to Pokryvailo et al., U.S. Pat. No. 6,366,251, and Goodall et al., U.S. Pat. No. 4,513,338 describe methods of high voltage protection, but they do not integrate an unintended electric charge dissipation methodology. Ironically, both of the above patents disclose an antenna that can create a condition of a dangerous static charge build up that can result in harmful electric shock if a human body acts as a discharge path for the accumulated charge. Radio equipment may be damaged by this unintended accumulated electric discharge event. When such discharge paths are created temporarily around the whip antenna's base insulator, the fast rise-time of the discharge pulse consists of theoretically infinite and intense radio frequency spectral components that are capable of damaging sensitive radio communication equipment.

Accumulated electric charge may result from natural phenomena such as rain static and more recently observed, desert air plasma effects. A desert air plasma effect is a condition where a vehicle employing a whip antenna accumulates an electric charge resulting from a "far-off" lightning storm system while placed in a desert environment. It is speculated that a plasma field condition originating from the storm cloud system, propagates electric plasma through the dry desert air that results in a substantial charge build-up in the antenna system that is employing a "high-voltage protection device/capacitor." This charge build-up continues until a resulting uncontrolled electric discharge event manifests itself. This charge effect has resulted in "gun shot" like sounding discharge events that can be very disconcerting in a desert military theater of operations as well as causing damage to communications equipments.

The patent to Pokryvailo et al., U.S. Pat. No. 6,366,251, discusses a "non-linear capacitor" that is characterized by a negative low-frequency voltage coefficient, whereby the passage of a high frequency alternating current remains essentially unaffected. This patent discloses that the inventors, after having tested numerous off-the-shelf capacitors, lay claim to some desirable attributes of a particular inherent flaw in some capacitors if not all. They assert that after subjecting a high-voltage rated capacitor, particularly ones that use a strontium-based ceramic, to 24 KV that the value of capacitance decreases. It is further asserted that this has the beneficial effect of increasing the low frequency impedance thereby insuring the current is below 5 milliamperes while continuing to provide minimal effect on the high frequency operation of the whip antenna. It is concluded that the bigger this characteristic drop in capacitance the better and further that this drop is "non-linear."

It is acknowledged that subjecting any high voltage rated capacitor to 24 KV will cause it to heat up due to inherent losses. The more it heats up, the more it expands, and the more the "plates" move apart and so drops the capacitance. The '251 patent asserts that Goodall et al, U.S. Pat. No. 4,513,338, is flawed because a capacitor using a Teflon™ dielectric is "linear" and therefore cannot possibly be designed to limit low frequency current to below 5 milliamperes while passing an "unobstructed" high frequency current. Goodall teaches that a value of "linear" capacitance, typically 500 picofarads, can be achieved that will limit low frequency current to below 5 milliamperes with an attendant whip antenna that can be designed to correctly function in its presence. The "unobstructed" high frequency current may be a matter of subjection, since if the value of capacitance has indeed deceased, the capacitive reactance (the obstruction) has increased by the well known relation: $X_c=1/(2*\pi*f*C)$. Also, since the capacitance has decreased, one may point out that the high frequency capacitance reactance of the non-linear capacitor may "interfere" more with high frequency whip antenna operations than the linear capacitor once heated up by a high voltage contact event. Without commenting upon the assertions made in the prior art, it is believed that the "hot" capacitance value is lower than the "cold" capacitance value. The bad thing is that the $X_c$ value is also greater at the radio frequency operation of the whip antenna, and could impede its normal operation until "cooled" off.

Therefore, there is a need for a high voltage protection device that prevents accidental electric shock to nearby personnel caused by incidental contact with high voltage electric power lines. And there is a need for the device to also integrate an incidental electric charge bleeder system for the purpose of discharging any accumulated electric charge.

SUMMARY OF THE INVENTION

It is thus an object of the present invention to provide a whip antenna high voltage protection device with integrated electric charge bleed-off system.

Another object of the present invention, which shall become apparent as the detailed description proceeds, is achieved by an antenna protection device, comprising a pair of opposed contacts; an inner electrode connected to one of the contacts; an outer electrode separated from the inner electrode and connected to the other of the contacts; and a resistor connected between the opposed contacts.

Other aspects of the present invention are attained by an antenna, comprising a proximal element; a distal element; and an antenna protection device disposed between the proximal and distal elements, the protection device comprising a capacitor enclosing an integrated resistor connected in parallel with the capacitor.

These and other objects of the present invention, as well as the advantages thereof over existing prior art forms, which will become apparent from the description to follow, are accomplished by the improvements hereinafter described and claimed.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1:
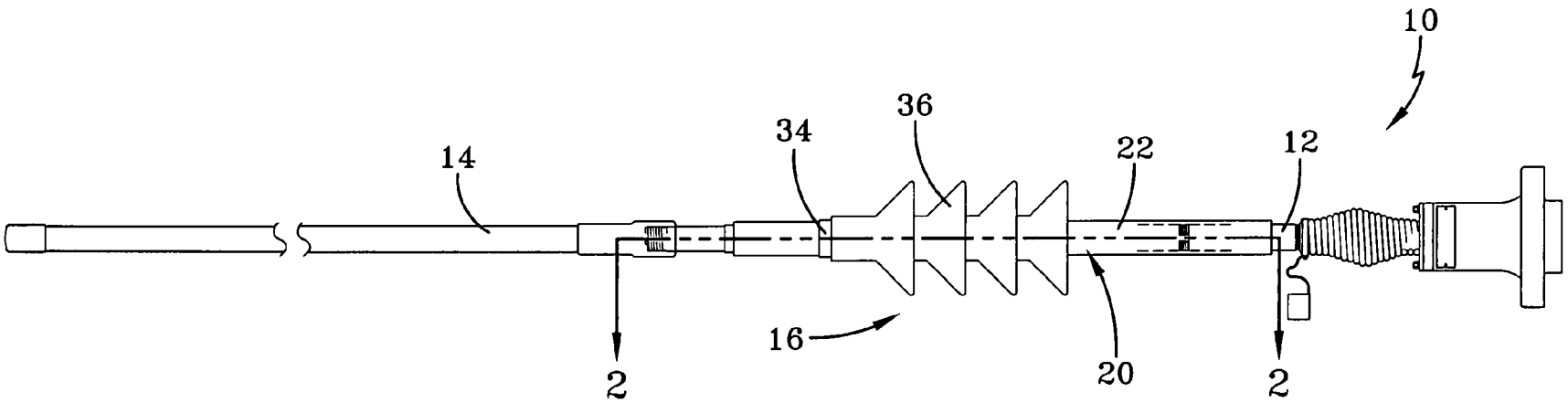
FIG. 1 is a schematic elevational view of an antenna incorporating the concepts of the present invention.
Figure 2:
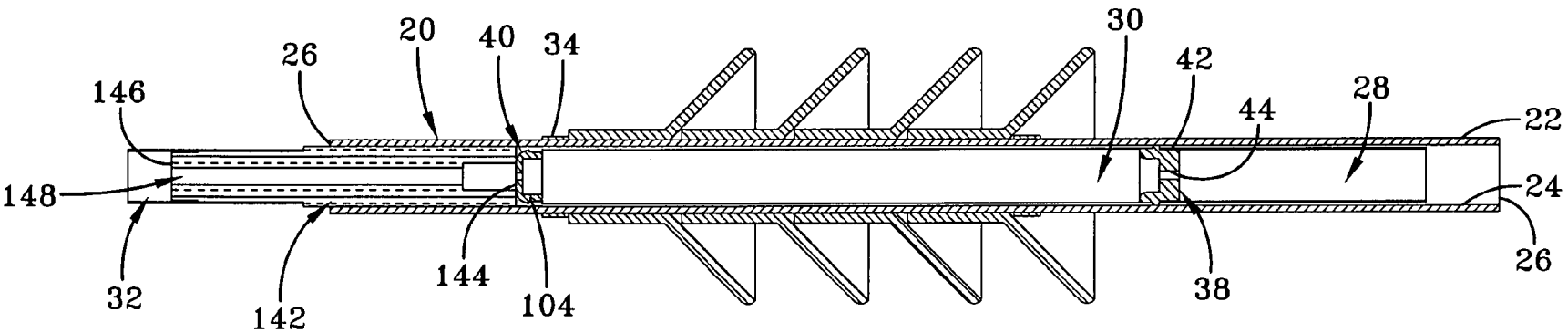
FIG. 2 is cross-sectional view of an antenna protection device made in accordance with the concepts of the present invention.
Figure 3:
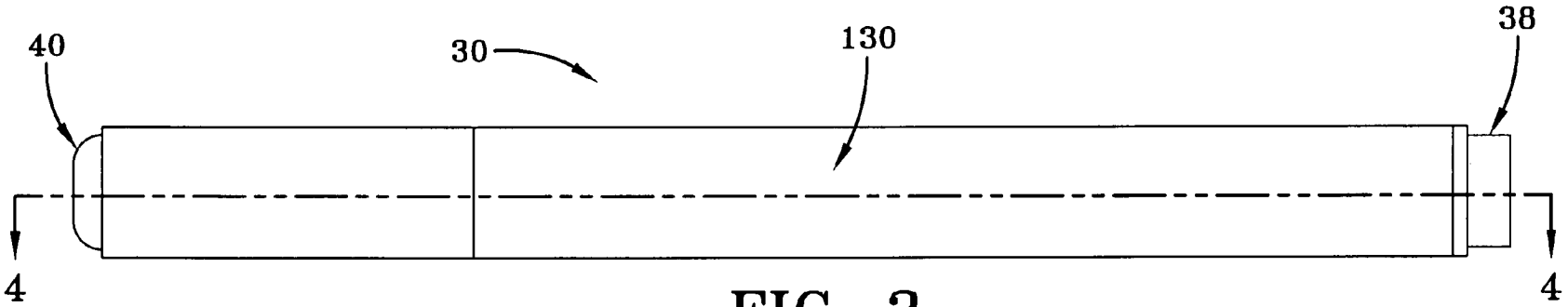
FIG. 3 is an elevational view of a protection element incorporated into the antenna protection device.
Figure 4:
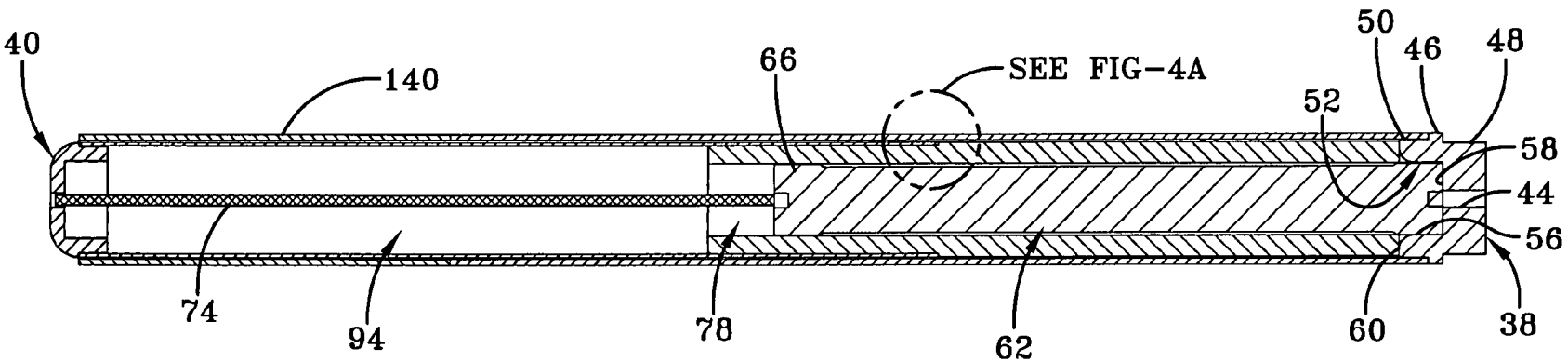
FIG. 4 is a cross-sectional view of the protection element taken along lines 4—4 of FIG. 3.
Figure 4A:
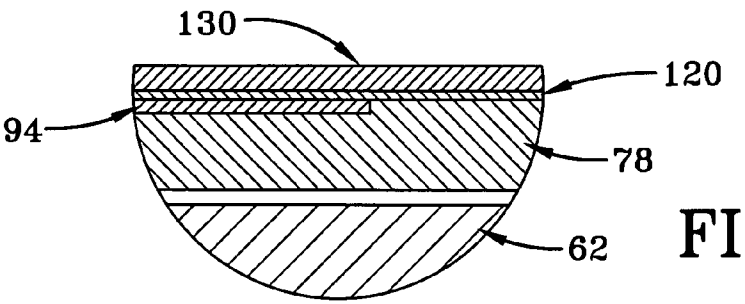
FIG. 4A is a detailed view of the protection element shown FIG. 4.
Figure 5:
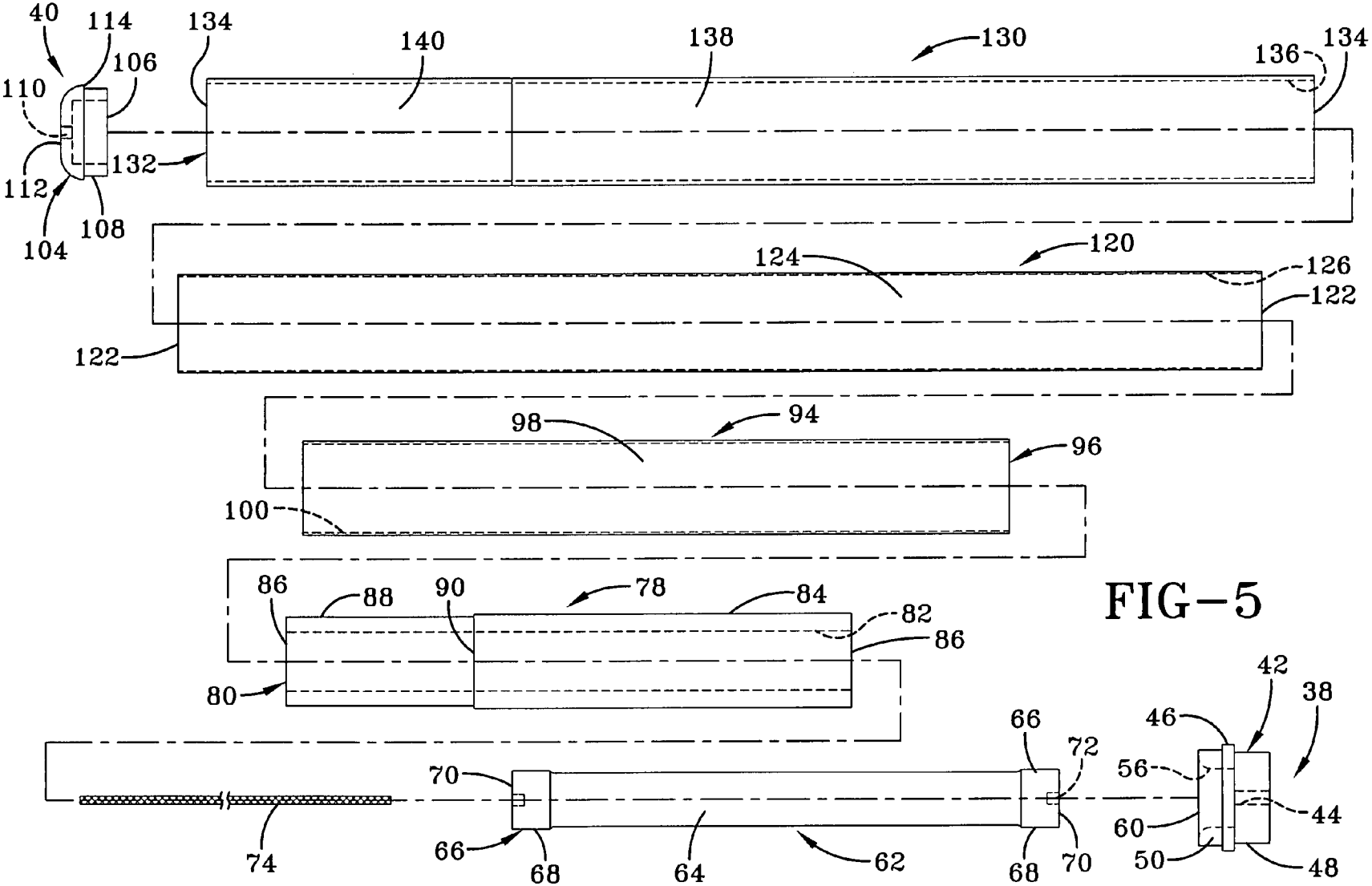
FIG. 5 is an exploded view of the protection element.

Referring now to the drawings and in particular to FIGS. 1 and 2 it can be seen that a whip antenna made in accordance with the concepts of the present invention is designated generally by the numeral 10. The antenna 10 is typically provided in multiple sections. The antenna includes a proximal conductor element 12 which is associated with the base of the antenna or in close proximity thereto and that is connectable to a distal conductor element 14 which is associated with the tip of the antenna. An antenna protection device, designated generally by the numeral 16, is interposed between the elements 12 and 14 for the purpose of protecting the overall operation of the antenna as will become apparent from the detailed description. It will be appreciated that the protection device 16 could be integrally incorporated into the antenna or provided between the elements. The protection device 16 is envisioned to be used in mobile military antenna applications, although it will be appreciated that it is equally applicable to other types of antennas.

The antenna protection device 16 includes a body tube 20 which is a tubular construction that has an exterior surface 22, an interior surface 24, and opposed ends 26. The tube 20 is preferably made from a polymeric, fiberglass or equivalent structural material. Received within the body tube 20 is a female ferrule 28 which is connected to one end of a protection element 30. A male ferrule 32 is also received within the body tube 20 and is connected to an opposite end of the protection element 30. The ferrules 28 and 32 are mateable with corresponding connectors and/or adaptors in the proximal and distal elements 12, 14 when the antenna is assembled. The ferrules are typically made of a conductive material and are rigid enough to support the interconnection of the protection device 16 to the corresponding elements 12 and 14. The body tube's exterior surface 22 may be surrounded by a supporting collar 34 which is made of either a polymeric or fiberglass material to provide structural support and to provide a binding surface for at least one drip ring 36. The drip rings 36 function to divert moisture or other materials away from the antenna 10 in a manner well known in the art.

Referring to FIGS. 2–5 it can be seen that the protection element 30 includes a female contact 38, which is connected to the female ferrule 28; and a male contact 40 at an opposite end which is connected to the male ferrule 32. The contacts 38 and 40 provide for an electrical connection to conductive elements contained within elements 12 and 14 so as to complete the antenna 10. Although the contacts 38 and 40 are shown as bearing against the respective connective surfaces associated with elements 12 and 14, it will be appreciated that threaded, spring-loaded or other fastening devices may be utilized for the contacts 38 and 40 to make connections to the corresponding elements.

The female contact 38 is typically made of a conductive material such as copper or aluminum and may be appropriately plated. The contact 38 includes a bushing 42 which may have a bushing hole 44 extending therethrough. Extending radially outwardly from the bushing 42 is a rim 46 such that the outer surface of the bushing provides a ferrule exterior surface 48 on one side of the rim and an outer electrode surface 50 on the other side of the rim. Contained within the interior of the bushing 42 is a resistor seat 52. The seat 52 is shaped as a counter-sink within the bushing 42 and is concentric with the bushing hole 44. The resistor seat 52 includes an inner wall 56 which is concentric with the bushing hole 44, wherein a stop surface 58 is substantially perpendicular with the inner wall and adjacent the bushing hole 44. An end surface 60 is also substantially perpendicular with the inner wall 56 and forms an end of the bushing 42 opposite the surface of the bushing proximal the female ferrule.

A resistor, which is designated generally by the numeral 62, is mateably received within the resistor seat 52. The resistor 62 includes a body 64 which has at each end a head 66 that has a slightly larger outer diameter than the body 64. Each head 66 includes a head exterior 68 and a head end 70. One of the heads 66 is received within the resistor seat 52 and in particular, the head exterior 68 fits within and is adjacent the inner wall 56. Accordingly, the corresponding head end 70 abuts or is closely adjacent to the stop surface 58. The head end 70 may provide a head aperture 72 which extends at least partially into the head 66. A threaded fastener may be received within the head aperture 72 via the bushing hole 44 for the purpose of securely connecting the resistor to the female contact 38. Of course, other means of connecting the resistor 62 to the contact 38 may be employed such as soldering, crimping, or riveting. Attached to head 66 opposite the female contact 38 is a conductor 74 which may be braided. Of course, other stranded or solid type conductors may extend from the head 66. The opposite end of the conductor 74 is connected to the interior surface of the male contact 40.

An inner insulator, which is designated generally by the numeral 78, is of a generally tubular construction. Accordingly, the insulator is adaptable to slidably receive the resistor 62 therein. In particular, the inner insulator 78 has an opening 80 therethrough and an interior surface 82 opposite an exterior surface 84. The insulator 78 has ends 86 wherein one of the ends abuts or is adjacent to the end surface 60 of the female contact 38. The exterior surface 84 provides for an exterior step surface 88 that is adjacent a step ledge 90. The exterior step surface 88 has a reduced outer diameter with respect to the exterior surface 84 so as to form the ledge 90 therebetween. The insulator 78 is typically made of a non-conductive polymeric or fiberglass material and electrically insulates the exterior of the resistor from other components contained within the element 30 but still allows for an electrical connect between the contacts 38 and 40. It will be appreciated that one end of the resistor 62 is received within the contact 38 and the remaining exterior surface of the resistor is enclosed within the insulator 78. Moreover, the end 86 opposite the female contact 38 is recessed within the inner insulator 78. In other words, the end of the insulator 78 extends beyond the end of the resistor 62 which provides the conductor 74.

An inner electrode, which is designated generally by the numeral 94, includes an inner electrode opening 96 therethrough. The electrode 94 is of a generally tubular construction and provides an exterior surface 98 which is substantially equivalent to the outer diameter of the exterior insulator surface 84. The electrode 94 also provides an interior surface 100 which is slightly larger than the exterior step surface 88 provided by the insulator 78. The inner electrode 94 fits around the exterior step surface 88 such that one end of the electrode 94 abuts or is positioned adjacent the step ledge 90. The opposite end of the inner electrode 94 is mateably received by the male contact 40. The inner electrode 94 is made of a conductive material such as copper, brass or other well-known material used in the manufacture of a capacitor contact or plate.

The male contact 40 is connected to the opposite end of the electrode 94 that contacts the step ledge 90. The male contact 40 includes a cap 104 which has an end surface 106 that is mateably received within the interior of the inner electrode 94. Extending from this end surface 106 is a side surface 108 which contacts the interior surface 100 of the electrode 94. The cap 104 may provide a cap hole 110 extending axially through the end surface 106. The cap hole 110 receives an end of the conductor 74 so as to allow for connection of the conductor to the contact. This connection may be in the form of soldering, crimping or other means needed to provide for an electrical and mechanical connection between the conductor 74 and the contact 40. The cap 104 also provides an electrode surface 112 that engages and connects with the receiving antenna element 14. The side surface 108 terminates at an edge stop 114 that is contiguous with the rounded edge of the electrode surface 112. Accordingly, the stop 114 is adjacent or abuts the end of the inner electrode 94.

The dielectric layer, which is designated generally by the numeral 120, is utilized to surround the exterior surfaces of the inner electrode 94 and the inner insulator 78. In the preferred embodiment, the dielectric layer 120 is made of a polyimide dielectric material which is available under the trade name Kapton. The dielectric layer 120 includes opposed ends 122 and is of a tubular construction. Or, the layer 120 could be a sheet of dielectric material that is wrapped around the inner electrode and the insulator with a sufficient overlap. The layer 120 provides an exterior surface 124 opposite an interior surface 126. In the preferred embodiment, the layer 120 extends from the stop surface 114 of the male contact all the way to the opposite end of the insulator 78. In other words, the dielectric layer 120 extends up to the electrode surface 50, but does not contact that surface.

An outer electrode, which is designated generally by the numeral 130, substantially encloses and surrounds the dielectric layer 124. In particular, the outer electrode 130 is of a tubular construction and provides for an outer electrode opening 132 therethrough which slidably receives the assembled components of the dielectric layer, the inner electrode, the inner insulator, the conductor 74 and the resistor 62. The electrode 130 includes opposed ends 134, and an interior surface 136 opposite an exterior surface 138. And the electrode 130 is likely made from the same or similar material as the inner electrode 94. Electrode 130 makes electrical contact with the contact 38 but does not make electrical contact with the male contact 40. In other words, the outer electrode is received on the outer electrode surface 50 of the contact 38 and is positioned in close proximity, but does not make any electrical or mechanical contact with the male contact 40. If desired, a heat shrink tube 140 may be disposed over the end of the outer electrode 130 adjacent the male contact 40 for the purpose of further insulating the outer electrode from the contact 40. The tubing is also less susceptible to voltage breakdown.

Referring back to FIGS. 1 and 2 it can be seen that the protection element 30 is received within the body tube 20. Also received within the body tube 20 is an adapter 142 that is positioned at least adjacent the male contact 40. The adapter extends outwardly from the body tube and is connected to the male ferrule 32. The adapter provides a contact end 144 which abuts or is adjacent to the male contact and wherein the end 144 is opposite an antenna end 146 that is disposed or connected to the male ferrule 146. The adapter 142 has an opening 148 axially therethrough which is aligned with the male ferrule and allows for receipt of an appropriate mating section provided by the distal element 14. The adaptor 142 is constructed of a polymeric or fiberglass material and provides structural support for the received distal end or element so as to withstand mechanical forces imported upon the tip end of the antenna.

From the above description it is readily apparent to one skilled in the art that the cylindrical features of the outer electrode and inner electrode are separated by an insulating layer. And that the resistor received within the cylindrical construction provides for an equivalent capacitor/resistor circuit element. Although any values of capacitance and resistance could be used, in the preferred embodiment the resistor has a value of about 20 Mega Ohms and the capacitor has a value of about 500 picofarads. Advantages of this construction will be discussed in detail below.

Figure 6:
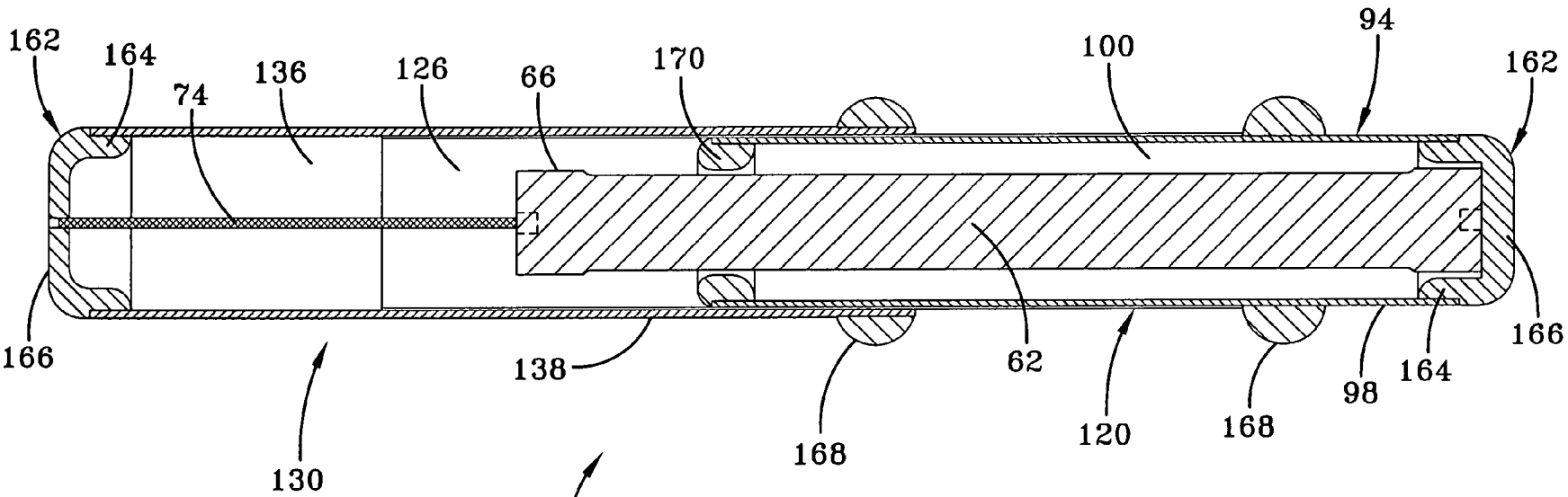
FIG. 6 is a perspective cross-sectional view of an alternative protection element made in accordance with the concepts of the present invention.
Figure 7:
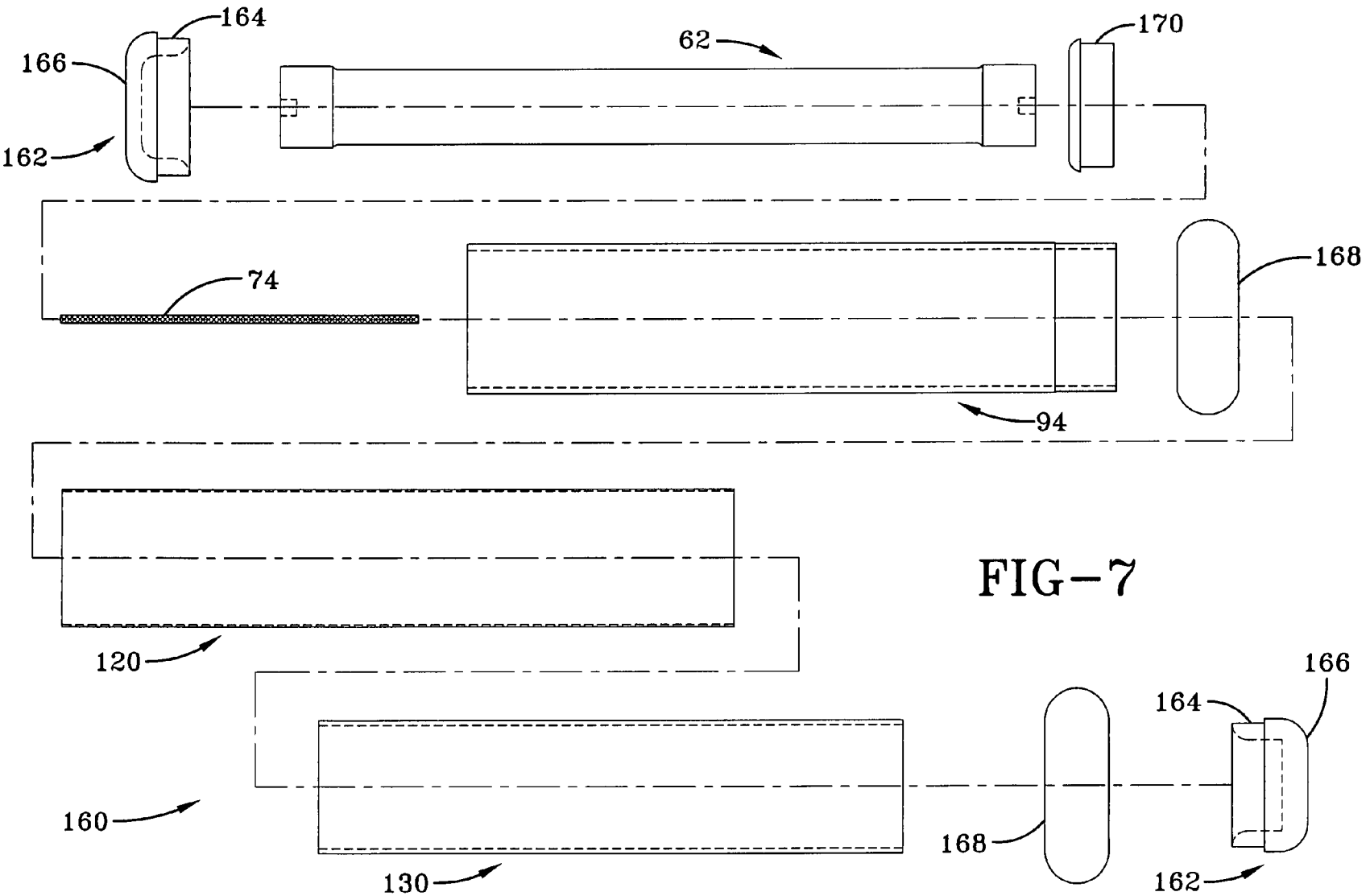
FIG. 7 is an exploded view of the alternative protection element.

Referring now to FIG. 6 it can be seen that an alternative antenna protection element is designated generally by the numeral 160. This element uses many of the same components as provided in the element 30, although they may be sized differently as needed in a particular construction. In any event, the element 160 includes contacts 162 which are disposed at both ends of the device. The contacts 162 provide a rim 164 which may be sized differently at each end so as to provide for connection at one end to the outer electrode, and to provide for connection at the opposite contact to the inner electrode. As in the previous embodiment, the electrodes are separated by a dielectric layer and the inner electrode is disposed within the insulator which receives the resistor element. The contacts are interconnected by the resistor element and the same effective resistor/capacitor integrated element is provided by the element 160. One added feature of the protection element 160 is that corona rings 168 are respectively provided around the exterior of the outer electrode and the inner electrode, and a smaller corona ring 170 is disposed between the end of the inner electrode and the resistor. The small corona ring is further disposed such as to be positioned at the end of the inner electrode that is received within the corresponding opening of the dielectric layer and outer electrode. The corona rings function to circumvent incidental sharp edges which may act to concentrate electric lines of force that would otherwise result in arcing.

The preferred embodiments consist of coaxially disposed conductive cylinders which make up at least two terminals of a capacitor. Spatial gaps separate the opposing conductive cylinders insulated by a vacuum, air, gas, or insulting material. The later is chosen for its electric voltage insulating characteristics as well as its low radio frequency energy loss characteristics. Such coaxially arranged conductive cylinders can be designed to obtain specific values of capacitance. The following formula describes such an arrangement.

$$\text{Capacitance} = \frac{(2*\pi*\varepsilon_r*\varepsilon_o)}{\ln\frac{(b)}{(a)}}$$

where b is the inside radius of the outer conductive cylinder and a is the outside of the inner conducting cylinder. The symbol $\epsilon o=8.854*10^{-12}$ Farads per meter. The symbol $\epsilon r$ is for relative permittivity, relative to $\epsilon o$. For instance, some common plastics have an $\epsilon r$ of 2.4, which means their permittivity is $2.4*\epsilon o$. Thus, choosing the appropriate cylinder sizes and material while providing enough space for the dissipative resistor, one can create a 500 pF capacitor while acting to house a desired resistor body form at the same time. The resistor is in an electrical parallel connection to the cylindrical capacitor. Analysis of such a combination is as follows:

$$X_C = i*\frac{1}{(2*\pi*f*c)} \quad R = \text{Resistor Value in Ohms}$$

The capacitor takes on a phase "quadrature" impedance to alternating current flow called capacitive reactance. Since this capacitive reactance is in quadrature to the Ohmic resistance, the two are analyzed employing complex mathematics.

$$Z = \frac{(R*X_c)}{R+X_c}$$

Then when, $$I_{complex}=E/Z$$

The resulting I, is the complex quantity of current made up of both resistive and capacitive reactive components. The complex "magnitude" is defined as follows:

$$|I_{complex}|=\sqrt{Re(I_{\text{complex}})^2+Im(I_{\text{complex}})^2}$$

It is this value that it should be less than 5 milliamperes in value, as mentioned in the prior art that is considered a "safe" maximum current in the event of accidental contact.

Based on the foregoing, the advantages of the present invention are readily apparent. The elements 30 and 160 enable an improved whip antenna with high voltage protection and an integrated electric charge bleed-off. And the antenna remains essentially transparent to the radio frequency electrical characteristics of the basic whip antenna design. Accordingly, an arrangement of two or more conductive cylinders, with interstitial dielectric insulating layers suitable for both high voltage isolation and low frequency energy losses is provided. Requisite to this assemblage is an internal Ohmic resistor which resides in the inner most cylinder and which makes up the essential bleeder resistor for electric charge dissipation. The invention is also advantageous in that it incorporates a "bleeder" resistor that is integrated with a high-voltage protection capacitor. The bleeder system discharges safely, any undesired static charging event. The capacitor is of a cylindrical configuration and designed to limit incidental low frequency line contact current to a safe level. Further, its broad contact area at its terminals can be designed to minimize "lead" inductance which removes the occurrences of parasitic resonances outside the whip antennas operating frequency range. Moreover, the protective elements do not significantly expand the overall outer diameter of the antenna as is sometimes found in the prior art.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. An antenna protection device, comprising:

a pair of opposed contacts;

an inner electrode connected to one of said contacts;

an outer electrode separated from said inner electrode and connected to the other of said contacts;

a resistor connected between said opposed contacts; and an inner insulator disposed between said electrodes and said resistor, wherein said resistor includes a conductor extending from one end thereof, and wherein said resistor is received within said insulator such that said conductor extends axially from said insulator and connects to one of said contacts and the opposite end of said resistor is connected to the other of said contacts.

2. The device according to claim 1, wherein said inner and outer electrodes are of a tubular construction with said inner electrode at least partially axially received within said outer electrode.

3. The device according to claim 1, wherein said inner and outer electrodes are of a tubular construction with said inner electrode at least partially axially received within said outer electrode, and wherein said inner and outer electrodes are separated by a dielectric layer.

4. An antenna protection device, comprising:

a pair of opposed contacts;

an inner electrode connected to one of said contacts;

an outer electrode separated from said inner electrode and connected to the other of said contacts;

a resistor connected between said opposed contacts; and an inner insulator disposed between said electrodes and said resistor, wherein said resistor has a conductor extending from one end thereof, and wherein said resistor is received within said insulator such that said conductor extends axially from said insulator and connects to one of said contacts and the opposite end of said resistor is connected to the other of said contacts.

5. The device according to claim 4, wherein said inner insulator has an exterior surface with an outer diameter and an electrode exterior surface having a reduced outer diameter which is axially received within said inner electrode.

6. An antenna protection device, comprising:

a pair of opposed contacts;

an inner electrode connected to one of said contacts;

an outer electrode separated from said inner electrode and connected to the other of said contacts;

a resistor connected between said opposed contacts; and a corona ring disposed around said resistor.

7. An antenna protection device, comprising:

a pair of opposed contacts;

an inner electrode connected to one of said contacts;

an outer electrode separated from said inner electrode and connected to the other of said contacts;

a resistor connected between said opposed contacts; and a corona ring disposed around said outer electrode.

8. An antenna protection device, comprising:

a pair of opposed contacts;

an inner electrode connected to one of said contacts;

an outer electrode separated from said inner electrode and connected to the other of said contacts;

a resistor connected between said opposed contacts; and a corona ring disposed around said inner electrode.

9. An antenna, comprising:

a proximal element;

a distal element; and an antenna protection device disposed between said proximal and distal elements, said protection device comprising a capacitor enclosing a resistor connected in parallel with said capacitor.

10. The antenna according to claim 9, said capacitor comprising:

an inner electrode connected to one of said elements;

an outer electrode separated from said inner electrode and connected to the other of said elements; and said resistor connected between said inner and outer electrodes.

11. The antenna according to claim 10, wherein said inner electrode is axially received within said outer electrode.

12. The antenna according to claim 11, further comprising:

a dielectric layer disposed between said inner and outer electrodes.

13. The antenna according to claim 9, further comprising:

a corona ring disposed around said resistor.

14. The antenna according to claim 9, further comprising:

a corona ring disposed around said outer electrode.

15. The antenna according to claim 9, further comprising:

a corona ring disposed around said inner electrode.

* * * * *